US007118418B1

(12) United States Patent
Huang

(10) Patent No.: US 7,118,418 B1
(45) Date of Patent: Oct. 10, 2006

(54) FEMAL CONNECTOR

(75) Inventor: Tien-Hung Huang, Miaoli (TW)

(73) Assignee: Jinlong Machinery & Electronics Co., Ltd., Taipei (KR)

( * ) Notice: Subject to any disclaimer, the term of this patent is extended or adjusted under 35 U.S.C. 154(b) by 0 days.

(21) Appl. No.: 11/239,236

(22) Filed: Sep. 30, 2005

(30) Foreign Application Priority Data

Apr. 4, 2005 (TW) ..... 94205400 U

(51) Int. Cl.
*H01R 13/648* (2006.01)

(52) U.S. Cl. ..... 439/607; 439/637

(58) Field of Classification Search ..... 439/607, 439/74, 60, 637
See application file for complete search history.

(56) References Cited

U.S. PATENT DOCUMENTS 5,921,814 A * 7/1999 Maruyama ..... 439/607
5,993,257 A * 11/1999 Maruyama ..... 439/607
6,299,481 B1 * 10/2001 Doi ..... 439/607
6,361,346 B1 * 3/2002 Matsuoka ..... 439/352
6,398,587 B1 * 6/2002 Chen et al. ..... 439/607
2002/0173201 A1 * 11/2002 Lappoehn ..... 439/607

FOREIGN PATENT DOCUMENTS

JP 2002015816 1/2002

* cited by examiner

*Primary Examiner*—Tulsidas C. Patel
*Assistant Examiner*—Vladimir Imas
(74) *Attorney, Agent, or Firm*—Birch, Stewart, Kolasch, Birch, LLP.

(57) ABSTRACT

A female connector comprises an insulating body having a socket inside and a rib positioned along a long direction of the socket. A gap is formed on the socket opposite to that rib, and a slot is positioned under the gap. A plurality of electrical leads protrude out of the insulating body. A metal housing enclosing the insulating body has a discontinuous portion. The discontinuous portion has a latch disposed on a first end of the discontinuous portion and a wing extending and inwardly hooking from a second end of said discontinuous portion. The latch is inserted into and engages with the slot.

6 Claims, 7 Drawing Sheets

FEMAL CONNECTOR

This application claims priority based on a Taiwanese patent application No. 094205400 filed on Apr. 4, 2005.

BACKGROUND OF THE INVENTION

1. Field of the Invention

The present invention relates to a female connector. Particularly, the present invention relates to a female connector for engaging with a male connector having a certain number of cables.

2. Description of the Related Art

Japanese patent publication No. 2002-15816 dated on Jan. 18, 2002 disclosed a "Female connector." As FIG. 1 shows, it comprises an insulation body 10. An indentation 19 is placed along a long direction, wherein a plurality of contact leads 17 are disposed within that indentation 19 with one end of each contact lead 17 protruding and extending outside of the insulation body 10. A frame-like mental housing 20 is assembled outside the insulation body 10. The mental housing 20 encloses and closely engages the insulation body 10. A gap 23 is located on one side of the mental housing 20.

A clip portion 29 is positioned upon two sides of the gap 23 on the mental housing 20; taking advantage of the elasticity of the metal housing 20, the insulation body 10 and engaged portion 13 engage with each other. Furthermore, metal housing 20 has segment portions 27 respectively disposed on two sides of the gap 23. Receiving portions 15 on the insulation body 10 are provided to receive the segment portions 27 such that the metal housing 20 and the insulation body 10 can be joined closely.

Nevertheless, the assembly of the prior art forces the clip portion 29 to squeeze into the engaged portion 13. Moreover, in order to join the segment portions 27 and receiving portions 15 together, it is required to bend the segment portions 27 inwardly. The manufacture process causes difficulties of assembly and quality control. It not only increases the ratio of poor quality of manufactured products but also causes more problems when connecting the female connector with male connector.

SUMMARY OF THE INVENTION

Thereof, it is an object of the present invention to provide a female connector that can be assembled with ease and is capable of producing good electrical connection with a male connector. At the same time, it ensures the excellent quality of manufactured products.

It is another object of the present invention to provide a female connector having good and stable Electromagnetic Interface (EMI) shielding effectiveness when connecting with a male connector.

The present invention achieves these and other objectives by providing a female connector comprising an insulating body having a socket inside and a rib positioned along a long direction of the socket. A gap is formed on the socket opposite to that rib, and a slot is positioned under the gap. A plurality of electrical leads protrude out of the insulating body. A metal housing enclosing the insulating body having a discontinuous portion. The discontinuous portion has a latch disposed on a first end of the discontinuous portion and a wing extending and inwardly hooking from a second end of said discontinuous portion. The latch inserts into and engages with the slot.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE PREFERRED EMBODIMENT

Figure 1:
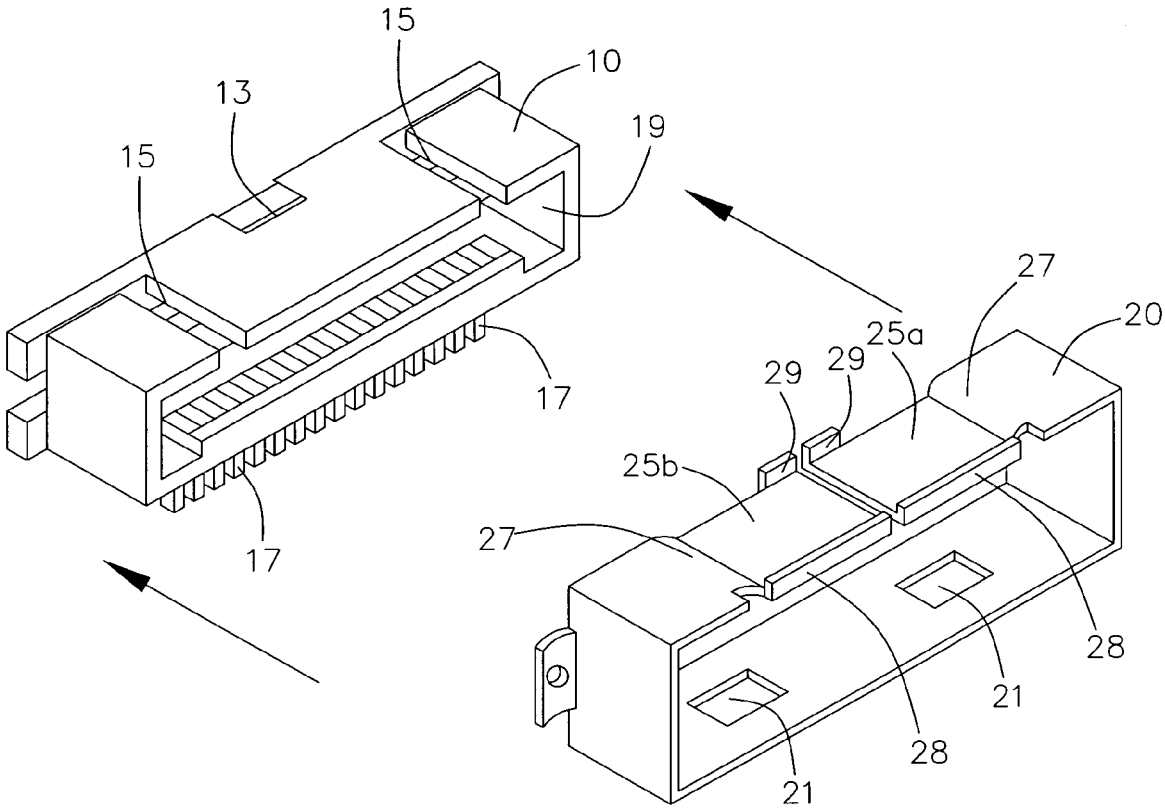
FIGURE 1 (Prior Art)
FIG. 1 is a decomposition view of a related art device.
Figure 2:
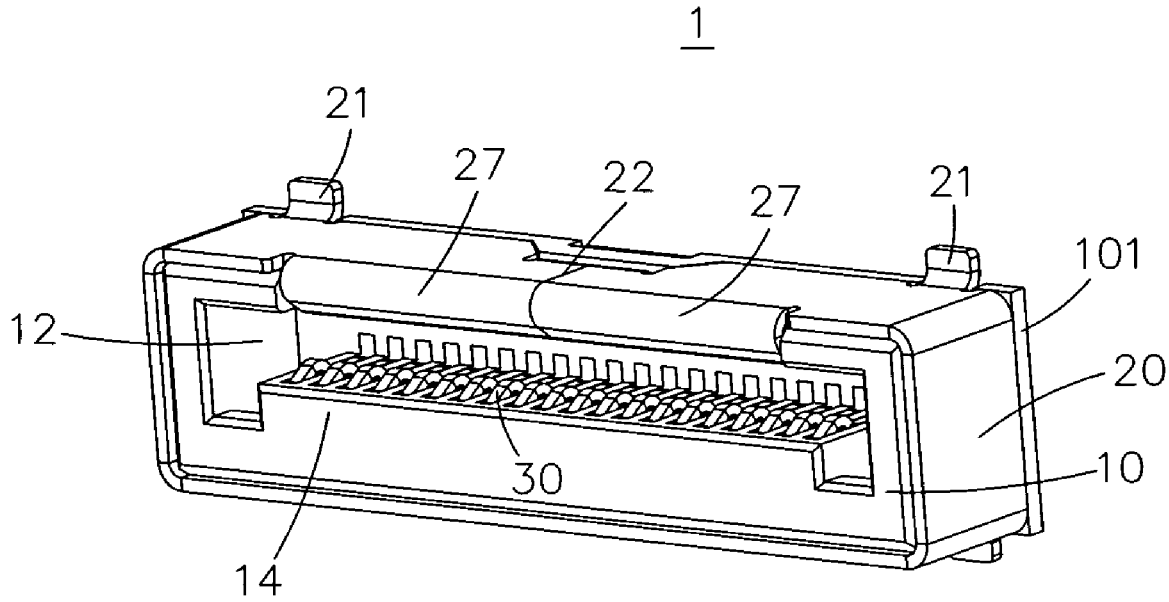
FIG. 2 is a perspective view of an embodiment of the present art device.

The preferred embodiments of the present invention are illustrated hereunder with attached drawings.

Please refer to FIG. 2 to FIG. 6, the invention disclosed herein relates to a female connector 1, which comprises an insulating body 10 having a socket 12 inside and a rib 14 on a side of the socket 12 positioned along the long direction. Opposite to the rib 14, a gap 16 is placed on an opposite side of the socket 12; a slot 18 is positioned there under.

Figure 3:
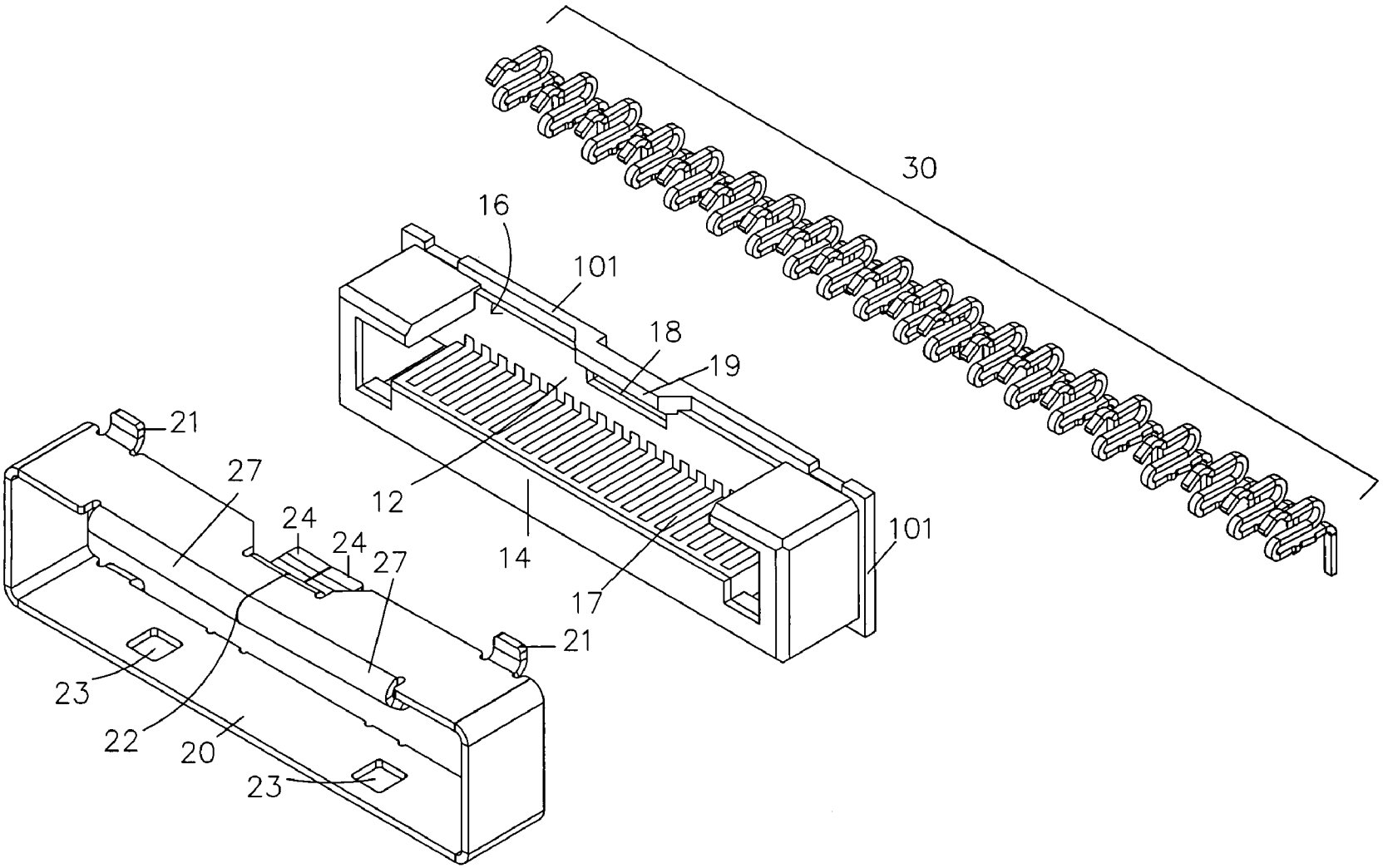
FIG. 3 is a decomposition view of an embodiment of the present art device.
Figure 4:
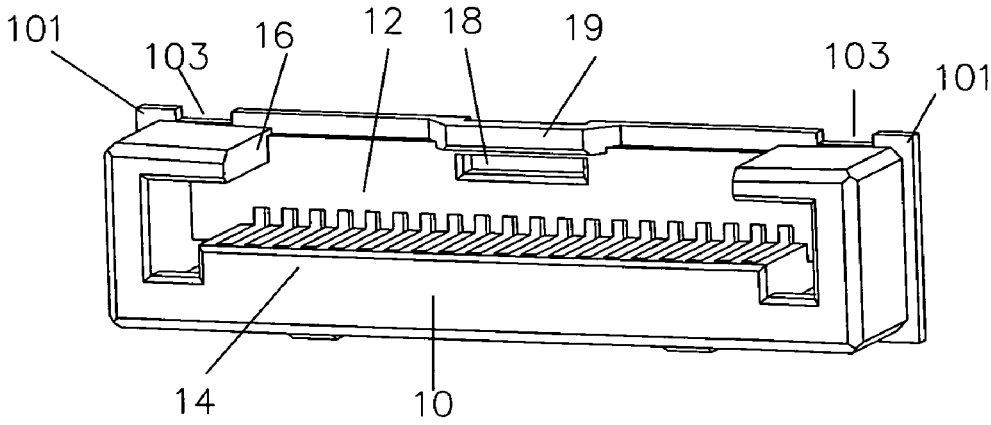
FIG. 4 is a perspective view of the insulating body shown in FIG. 2.
Figure 5:
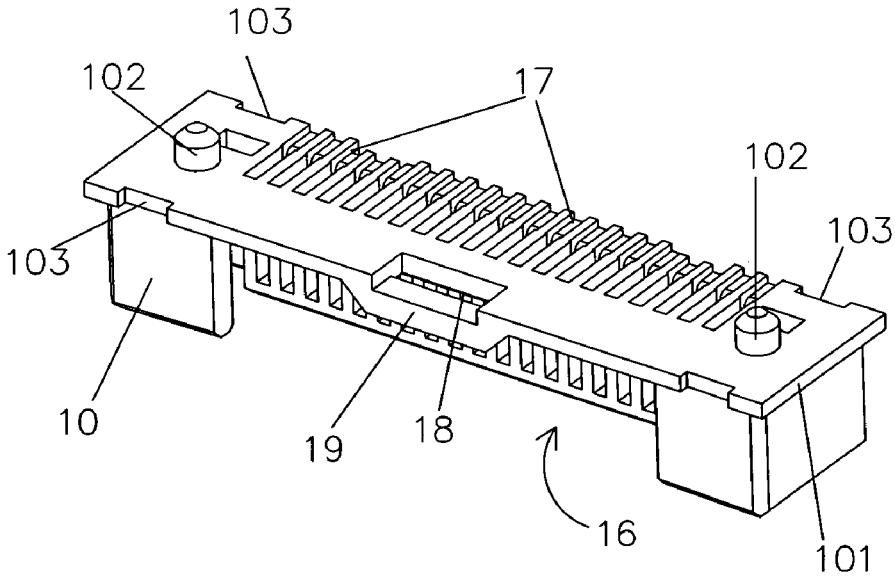
FIG. 5 is another perspective view of the insulating body shown in FIG. 2.
Figure 6:
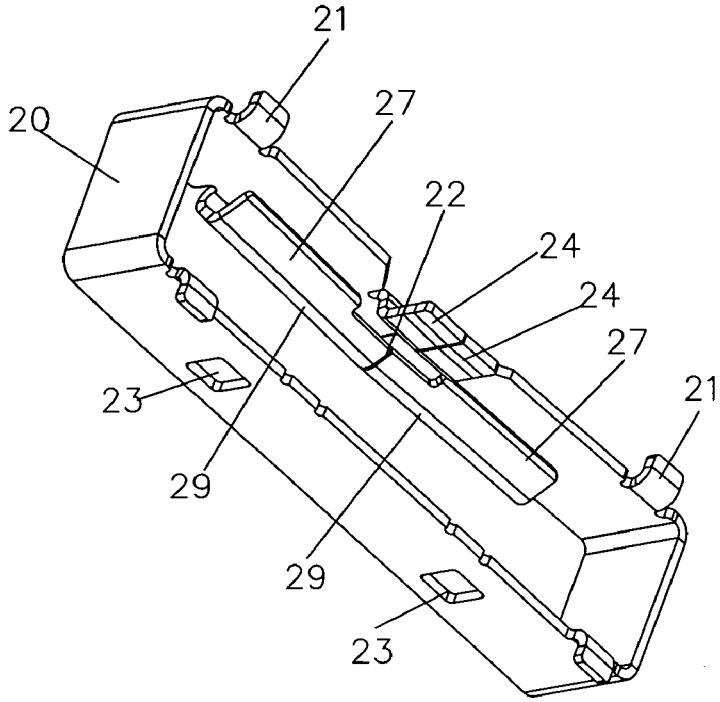
FIG. 6 is a perspective view of the wings and adjacent elements shown in FIG. 2.

A plurality of electrical leads 30 are separately disposed inside the lead notches 17 of the socket 12, and the electrical leads 30 protrude and extend outside of the insulating body 10. The protruding leads are provided to join printed circuit boards (not illustrated) by solder. A rectangular metal housing 20 encloses the insulating body 10. One side of the mental housing 20 has a discontinuous surface 22. The discontinuous surface 22 has a latch 24 disposed on a first end of the discontinuous surface 22 and a wing 27 hooking inwardly from a second end of the discontinuous surface 22. As the FIG. 3 and FIG. 6 show, the preferred embodiment of the metal housing 20 has a rectangular cross-section. In addition, in the preferred embodiment, the metal housing 20 includes two latches 24 and two wings 27. The two latches 24 and the two wings 27 are respectively disposed on two opposite sides of the discontinuous surface 22. The two latches 24 are divided by a discontinuous interval on the discontinuous surface 22. The two wings 27 are also divided by the discontinuous interval. The two latches 24 are inserted into and engage with the slot 18.

Particularly, the embodiment of the invention enables the metal housing 20 and the insulating body 10 to be joined smoothly without forcibly changing the form of any element or generating deformation on any element. It is easier to control the manufacturing quality of the connectors during the manufacture process, and thereby more consistent quality can be assured. After the latches 24 are inserted into the slot 18, latches 24 are bent to form bending pieces 26 in next step so as to engage with the slot 18. In addition, two bending pieces 26 are hidden inside a protruding part 19.

Figure 9:
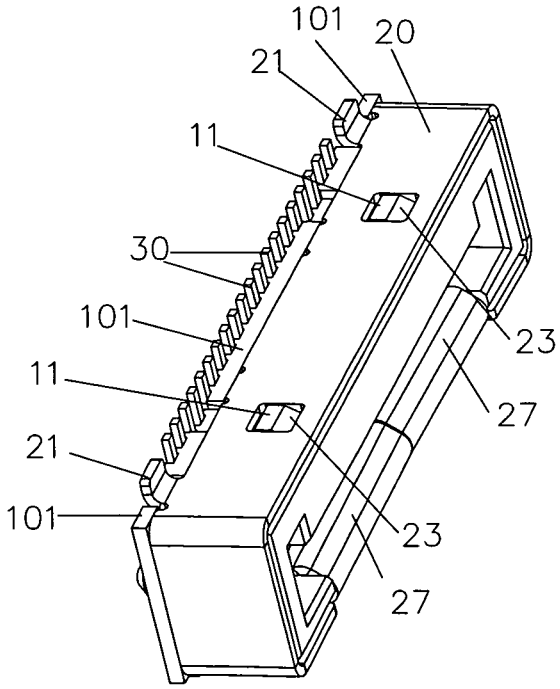
FIG. 9 is a perspective view showing the rear portion of the present invention.
Figure 10:
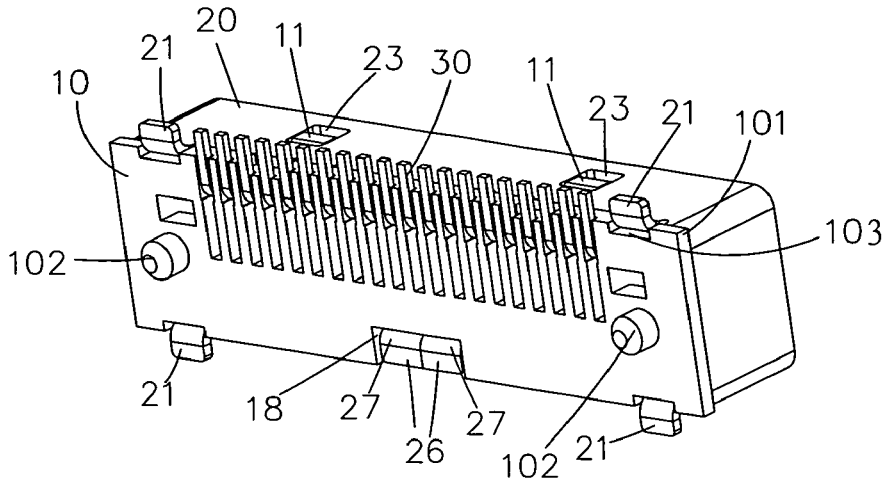
FIG. 10 is a perspective view showing the bottom portion of the present invention.

Two blocks 11 are disposed on one side of the insulating body 10 to buckle into the holes 23 on the metal housing 20. Some devices are provided to solder with printed circuit board, such as soldered pieces 21 positioned respectively at each corner of the bottom of the metal housing 20 and segment portions 103 correspondingly positioned on the insulating body 10. On the bottom of the insulating body 10, two position devices 102 are provided for correctly positioning a printed circuit board (not illustrated). A flange 101 extending from a bottom end of the insulating body 10 is provided for preventing a short circuit or a contact occurring between the electrical leads 30 and the metal housing 20 (As illustrated in FIG. 9 and FIG. 10).

Figure 7:
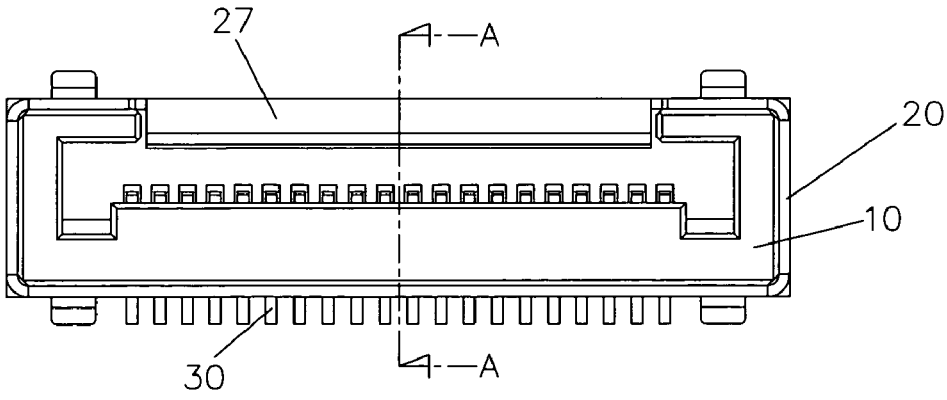
FIG. 7 is a top view of the present invention.
Figure 8:
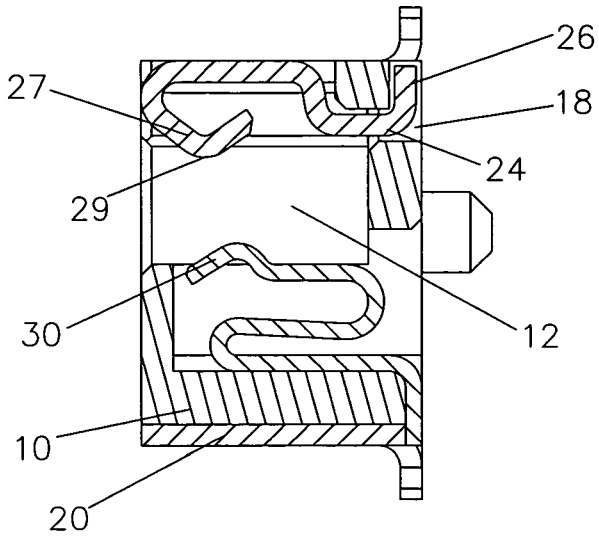
FIG. 8 is a A—A cross-sectional view of FIG. 6.
Figure 11:
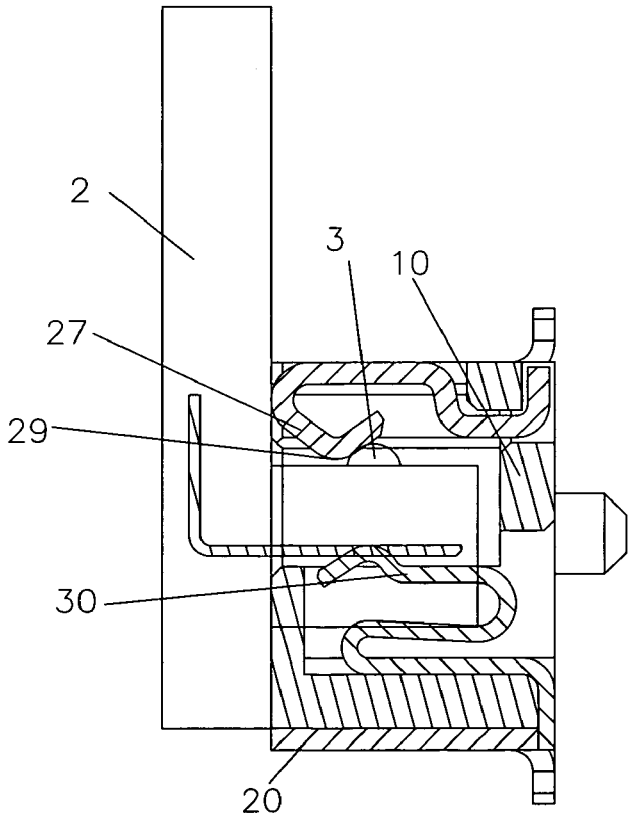
FIG. 11 is a cross-sectional view of the present art device showing the engagement with a male connector.

In the embodiment shown in FIG. 11, also referring to FIG. 7 and FIG. 8, two inwardly-hooking wings 27 are separately disposed on the first end of the discontinuous surface 22. When connecting to a male connector 2, a raised protrusion 29 of the wing 27 engages with a contact point 3 of the male connector 2.

As a result, when the female connector 1 of the embodiment connects to the male connector 2, the flexibility of the wings 27 enables the male connector 2 to establish firm contact with the female connector 1. Thereof, the connection between the male connector 2 and the female connector 1 is easier to be made. At the same time, the connection creates a superior and stable Electromagnetic Interface Shielding Effectiveness.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A female connector, comprising;

an insulating body having a socket, a rib positioned on a side of said socket along a long direction of said socket, a gap formed on another side of said socket opposite to said rib, and a slot positioned under said gap;

a plurality of electrical leads separately disposed inside said socket, said plurality of electrical leads protruding out of the said insulating body; and a metal housing enclosing said insulating body, one side of said metal housing having a discontinuous surface, said discontinuous surface having a latch disposed on a first end of said discontinuous surface and a wing inwardly hooking from a second end of said discontinuous surface; wherein said latch inserts into and engages with said slot.

2. The female connector of claim 1, wherein said latch includes a bending piece engaging with said slot.

3. The female connector of claim 1, wherein said wing includes a protrusion.

4. The female connector of claim 1, wherein a flange extends from a bottom end of said insulating body.

5. The female connector of claim 1, wherein said mental housing has a rectangular cross-section.

6. The female connector of claim 1, wherein said discontinuous surface has a discontinuous interval across said discontinuous surface, two latches being disposed on the first end of said discontinuous surface and divided by said discontinuous interval.

* * * * *